US009670928B2

(12) United States Patent
Lo Biundo et al.

(10) Patent No.: US 9,670,928 B2
(45) Date of Patent: Jun. 6, 2017

(54) VACUUM PUMP FOR A MOTOR VEHICLE ENGINE

(75) Inventors: Giuseppe Lo Biundo, Partinico (IT); Alessandra De Rango, Granarolo Emilia (IT); Giovanni Pazzi, Cento (IT); Carlo Pachetti, Cascina (IT)

(73) Assignee: O.M.P. Officine Mazzocco Pagnoni, S.R.L., Funo Bo (IT)

( * ) Notice: Subject to any disclaimer, the term of this patent is extended or adjusted under 35 U.S.C. 154(b) by 1462 days.

(21) Appl. No.: 12/667,319

(22) PCT Filed: Jul. 3, 2007

(86) PCT No.: PCT/IT2007/000476

§ 371 (c)(1),
(2), (4) Date: Apr. 16, 2010

(87) PCT Pub. No.: WO2009/004657

PCT Pub. Date: Jan. 8, 2009

(65) Prior Publication Data

US 2010/0196187 A1 Aug. 5, 2010

(51) Int. Cl.
*F04C 18/344* (2006.01)
*F04C 28/04* (2006.01)
(Continued)

(52) U.S. Cl.
CPC ..... *F04C 18/3442* (2013.01); *F01C 21/0881* (2013.01); *F04C 27/001* (2013.01); *F04C 2220/10* (2013.01)

(58) Field of Classification Search
CPC .. F01C 21/0881; F01C 21/0836; F01C 1/344; F04C 27/001; F04C 2220/10; F04C 18/3445
(Continued)

(56) References Cited

U.S. PATENT DOCUMENTS 600,723 A * 3/1898 Johnson ..... 418/112
2,200,198 A * 5/1940 Beach ..... 418/147
(Continued)

FOREIGN PATENT DOCUMENTS

DE 198127 5/1908
DE 1242100 6/1967
(Continued)

OTHER PUBLICATIONS

Japanese Office Action Dated May 22, 2012.

*Primary Examiner* — Mark Laurenzi
*Assistant Examiner* — Anthony Ayala Delgado
(74) *Attorney, Agent, or Firm* — Husch Blackwell LLP

(57) ABSTRACT

A vacuum pump for a motor vehicle engine which has a stator and a chamber, has a side wall, and the side wall has a transversal section with a predetermined shape. The rotor mounted in the chamber is capable of rotating around a rotation axis parallel to the side wall. The vane mounted on the rotor is free to slide in a direction at right angles with respect to the rotation axis of the rotor, and the vane has a predetermined length and two opposite end portions that substantially slide along the side wall of the chamber. At least one of the end portions of the vane has at least one part that has a bend radius substantially equal to that of a part of the side wall, when the one vane is at a reference operating position.

7 Claims, 6 Drawing Sheets

(51) Int. Cl.
*F01C 21/08* (2006.01)
*F04C 27/00* (2006.01)

(58) Field of Classification Search
USPC ..... 418/253, 254, 255, 150, 211, 259
See application file for complete search history.

(56) References Cited

U.S. PATENT DOCUMENTS

| | | | | |
|---|---|---|---|---|
| 3,723,034 | A | 3/1973 | Johnson et al. | |
| 4,133,617 | A * | 1/1979 | Reynaud | 418/150 |
| 4,373,880 | A * | 2/1983 | Tanaka et al. | 418/150 |
| 4,515,123 | A * | 5/1985 | Taylor | 123/222 |
| 4,957,420 | A * | 9/1990 | Furuhama | 418/255 |
| 5,442,553 | A | 8/1995 | Parrillo | |
| 5,779,463 | A | 7/1998 | Rossel et al. | |
| 5,999,908 | A | 12/1999 | Abelow | |
| 6,866,491 | B2 * | 3/2005 | Maeng | 418/112 |
| 7,628,595 | B2 * | 12/2009 | Ono et al. | 418/255 |
| 7,661,940 | B2 * | 2/2010 | Maeng | 418/258 |
| 7,674,096 | B2 * | 3/2010 | Sundheim | 417/234 |
| 2003/0053924 | A1 * | 3/2003 | Hasert et al. | 418/152 |

FOREIGN PATENT DOCUMENTS

| | | | | |
|---|---|---|---|---|
| DE | 2017624 | | 5/1972 | |
| DE | 3913989 | | 9/1989 | |
| DE | 3934280 | | 4/1990 | |
| DE | 10046697 | | 4/2002 | |
| DE | 102004034921 | | 12/2005 | |
| DE | 102008019440 | | 10/2009 | |
| EP | 694234 | | 1/1996 | |
| GB | WO 03081049 | A1 * | 10/2003 | F01C 21/106 |
| JP | 91014 | B | 4/1931 | |
| JP | 58174192 | | 10/1983 | |
| WO | 03014571 | | 2/2003 | |
| WO | 2006005381 | | 1/2006 | |

* cited by examiner

PRIOR ART Fig.1

PRIOR ART

VACUUM PUMP FOR A MOTOR VEHICLE ENGINE

The present invention relates to a vacuum pump, preferably of the so-called single-vane type.

In particular, the invention relates to a vacuum pump for a motor vehicle engine, preferably but not necessarily limited to heavy motor vehicles and/or to high-powered motor vehicles, said vacuum pump being for example intended to create a particular depression to activate and operate specific devices provided on the motor vehicle, such as for example the servobrake.

The invention also relates to a vane for said vacuum pump.

Generally a single-vane vacuum pump for a motor vehicle comprise a stator, a depression chamber defined within a stator, a rotor mounted inside the depression chamber and a vane mounted on said rotor and free to move with respect to the rotor. In turn, the vane comprises a central body and two opposite end portions that are integrally formed with said body which substantially slide on the chamber walls.

The desired depression is obtained through the rotation of the vane in the depression chamber and to the simultaneous sealing action performed by the end portions of the vane at the wall of said chamber.

In known single-vane vacuum pumps currently available on the market, the opposite end portions of the vane have, in a longitudinal section of the vane, a substantially semicircumferential shape, with a diameter that is substantially equal to the thickness of the central body of the vane.

Although this is advantageous under several points of view, a single-vane vacuum pump constructed as schematically described above, has drawbacks that occur above all when the rotation speed of the rotor is particularly high. In fact, the end portions of the vane, acting as sliding blocks of the vane along the wall of the stator chamber, are subject to wear, which is as higher as the rotation speed of the rotor is higher.

In particular, the Applicant observed that, above all at particular angular positions of the vane, high contact pressure occurs between the end portions of the vane and the wall of the chamber, since the contact surfaces are extremely limited: this high contact pressure definitively causes a high wear.

Furthermore, the Applicant observed that the length of the vane, that is the distance between the two points of the respective end portions of the vane positioned on the longitudinal axis of the vane, is always less than the theoretical length of the vane, that defined the predetermined shape of the transversal section of the side wall of the chamber: this is due to the fact that having the central body of the vane a predetermined thickness, if the length of the vane were equal to the theoretical length, it would not be able to rotate inside the chamber because in certain operating configurations the semicircumferential end portions of the vane would "interfere" against the wall of the chamber.

The aforesaid difference between the theoretical length and the actual length of the vane creates a certain play between the vane and the chamber wall: in particular in certain operating configurations where the force of inertia of the vane substantially counterbalances the centrifugal force of the vane, the opposite end portions of the vane alternately strike against opposite sides of the wall of the chamber, which also causes damage to the ends of the vanes as well as the wall of the chamber, forming relative undulations caused by the removal of wall material.

The technical problem at the basis of the present invention is to overcome or at least to attenuate the drawbacks described above with respect to the prior art.

Therefore, in a first aspect thereof, the present invention relates to a vacuum pump for a motor vehicle engine, comprising:

- a stator;
- a chamber defined within said stator, said chamber having a side wall whose transversal section has a predetermined shape;
- a rotor mounted in said chamber and capable of rotating around a rotation axis parallel with said side wall;
- at least one vane mounted on said rotor and free to slide in an direction at right-angles with respect to the rotation axis of said rotor, said at least one vane having a predetermined length and two opposite end portions that slide along the side wall of said chamber;

characterised in that at least one of said end portions of said at least one vane comprises at least one part having a bend radius substantially equal to that of a part of said side wall, when said at least one vane is at at least one reference operating position.

Advantageously, the vacuum pump of the present invention allows to reduce the wear of the end portions of the vane and the chamber considerably, with the result that this permits much higher rotation speed of the rotor.

In fact, the vane of the vacuum pump of the present invention is shaped so that at least one part of at least one end portion thereof is substantially in contact with a part of the side wall of the chamber defined inside the stator while the vane is in a particular reference operating position: in this manner, the contact pressure (and the consequential wear) between the end portion of the vane and the side wall of the chamber defined inside the stator is relatively small, because the contact surfaces are quite large, much more than the "point-contact" between the semicircumferential end portion of the vane and the side wall of the chamber of a vacuum pump according to the prior art previously described.

Preferably, said at least one reference operating position is defined at a configuration of maximum stress on the end portions of said at least one vane against the side wall of the chamber.

Advantageously, in this case, the end portion of the vane presents a large contact surface with the side wall of the chamber exactly at the operational configuration wherein the vane is more subjected to stress, thus limiting the contact pressure between the end portion of the vane and the side wall of the chamber and, in this way, reducing the wear to a very large extent.

In the preferred embodiment of the vacuum pump of the present invention, said at least one vane is free to slide in a direction passing through the rotation axis of said rotor, the external circumference of said rotor is tangential to the side wall of the chamber along a tangential line parallel to the rotor rotation axis, and the side wall comprises a part shaped as an arc of circumference having a predetermined radius, each of said end portions of said at least one vane comprising at least two parts having respective bend radii that are different from one another.

Advantageously, this specific embodiment makes it possible for at least one part of the end portions of the vane to be substantially in contact with the side wall of the chamber one at a time, when the longitudinal axis of the vane is at right angles with respect to the plane defined by the rotor rotation axis and the aforesaid tangential line: in this manner the end portions of the vane slide against the side wall of the chamber with large contact surfaces in the operational areas where the vane is subjected to more stress, said zones being precisely those around the position wherein the longitudinal axis of the vane is at right angles with respect to the plane formed by the rotor rotation axis and the aforesaid tangential line.

In a first preferred embodiment, each of said end portions of said at least one vane comprises two opposite parts that are symmetrical with respect to a longitudinal axis of said at least one vane and having respective bend radii substantially equal to said predetermined radius.

In a second preferred embodiment, each of the said end portions of said at least one vane comprises a first part having a bend radius substantially equal to said predetermined radius.

Advantageously, this second preferred embodiment allows the manufacturing costs of the vane of the vacuum pump to be reduced, since only one part of each of the end portions of the vane needs to be shaped in an appropriate manner: in particular, it is simply sufficient to adequately shape only the two parts that are each time in contact with the side wall of the chamber when the longitudinal axis of the vane is at right angles with respect to the plane formed by the rotor rotation axis and the aforesaid tangential line. The aforesaid cost reduction is very advantageous considering the fact that the end portions are often manufactured in a more expensive material than the remaining parts of the vane.

Preferably, in the aforesaid second embodiment, each of the said end portions of the said at least one vane comprises a second part substantially parallel to a longitudinal axis of said at least one vane.

More preferably, in the aforesaid second embodiment, said first parts of said end portions are positioned on opposite side with respect to the longitudinal axis of said at least one vane.

Preferably, in all the aforesaid embodiments of the vacuum pump of the present invention, said parts of each of said end portions of said at least one vane are radiused by an arc of circumference at a longitudinal axis of the vane.

Advantageously, in this manner it is possible to manufacture vanes having a length much closer to the theoretical length described above, thus reducing the amount of play between the vane and the side wall of the chamber to a very large extent: this reduces considerably any damage to the vane ends and side walls of the chamber as described with respect to the prior art.

Even more preferably, the diameter of the ideal circumference that defines the aforesaid arc of circumference is smaller than the thickness of said at least one vane. In particular, the ratio between the diameter of the ideal circumference that defines the aforesaid arc of circumference and the thickness of the vane preferably ranges between ⅕ and ¼.

Advantageously, the Applicant observed that with the aforesaid values it is possible to manufacture vanes having a length that varies very little from the theoretical length previously described.

In a second aspect thereof, the present invention relates to a vane for a vacuum pump for a motor vehicle engine, comprising a central body and two opposite end portions that are substantially adapted to slide on a side wall of a chamber provided inside a stator of said vacuum pump, characterised in that at least one of said end portions of said vane comprises at least two parts having respective bend radii that differ from one another.

Advantageously, once the vane of the present invention is mounted in the corresponding vacuum pump, this allows to reduce the wear of the end portions of the vane to a very large extent, with the result that very high rotation speed of the vacuum pump rotor can be obtained.

In fact it is possible to shape at least one part of each of the end portions of the vane according to a bend ratio that is substantially equal to that of a part of the side wall of the chamber of the vacuum pump stator on which the vane is mounted, so that the two parts of the vane are in turn substantially in contact with the corresponding parts of the side wall of the chamber of the stator: when this occurs, the contact pressure (and the consequential wear) between the end portion of the vane and the side wall of the chamber of the stator is relatively small, because of the fact that the contact surfaces are quite large, much more than the "point-contact" between the semicircumferential end portion of the vane and the side wall of the chamber of a vacuum pump stator according to the prior art previously described.

Advantageously, such vane can be used in the vacuum pump of the present invention described above.

Preferably, said vane has individually or in combination all the structural and functional characteristics described above with respect to the vane of the vacuum pump of the present invention and therefore it allows to achieve all the advantages previously described.

In a first embodiment, each of the said end portions comprises two opposite parts that are symmetrical with respect to a longitudinal axis of said vane and having respective bend radii that are substantially equal to a predetermined radius.

In a second embodiment, each of said end portions comprises a first part having a bend radius substantially equal to a predetermined radius, and a second part substantially parallel to a longitudinal axis of said vane.

Preferably, in the aforesaid second embodiment, said first parts of said end portions are positioned on opposite side with respect to the longitudinal axis of said vane.

More preferably, in all the aforesaid embodiments, said parts of each of said end portions are radiused, at a longitudinal axis of said vane, by an arc of circumference.

Even more preferably, in said vane the diameter of the ideal circumference that defines said arc of circumference is smaller than the thickness of the vane. In particular, the ratio between the diameter of the ideal circumference that defines said circumferential arc and the thickness of the vane preferably ranges between ⅕ and ¼.

Further characteristics and advantages of the present invention will be made more apparent from the following detailed description of some preferred embodiments thereof, with reference to the attached drawings, provided without any limiting purpose and only by way of illustration. In these drawings.

Figure 1:
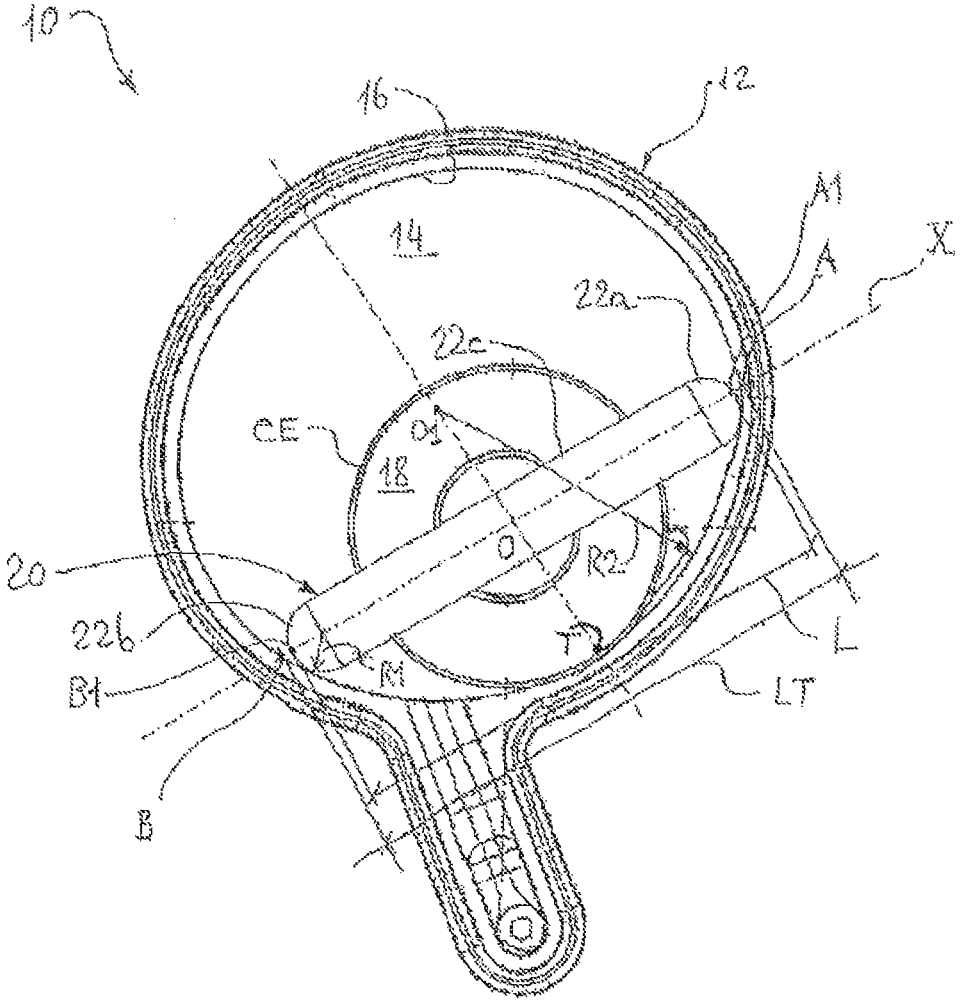
FIG. 1 is a schematic plane view seen from above of a single-vane vacuum pump according to prior art, without the upper cover to show the chamber of the stator.

With initial reference to FIG. 1, a vacuum pump is shown, in particular a single-vane vacuum pump for a motor vehicle engine, according to the prior art and identified by the reference numeral 10.

The vacuum pump 10 comprises a stator 12 inside which a chamber 14 is defined. The chamber 14 has a side wall 16 whose transversal section has a predetermined shape.

A rotor 18 is mounted inside the chamber 14. The rotor 18 is capable to rotate around a rotation axis (in FIG. 1, this is illustrated by the point O) parallel to the side wall 16.

A vane 20 is mounted on the rotor 18 so that it is free to slide in a direction at right angles with respect to the rotation axis (O) of rotor 18. The vane 20 has a predetermined length L and two opposite end portions 22*a* and 22*b* which, during the operation of the vacuum pump 10, substantially slide on the side wall 16 of the chamber 14.

Figure 2:
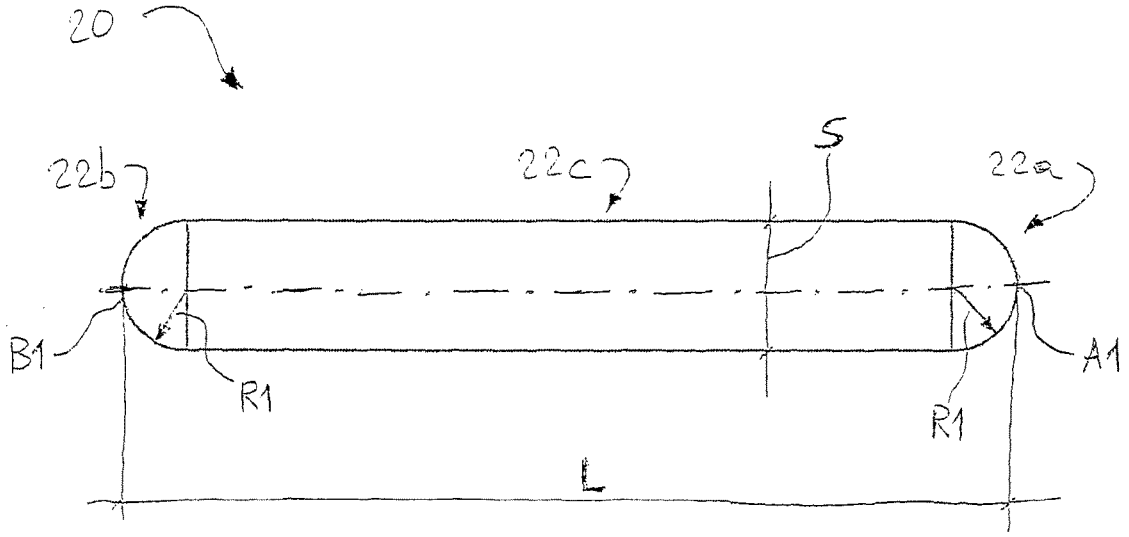
FIG. 2 is a schematic plane view seen from above, and in enlarged scale, of the vane included in the vacuum pump shown in FIG. 1.

As shown in FIG. 2, in the prior art the opposite end portions 22*a* and 22*b* of the vane have a semicircumferential shape or profile in the longitudinal section, with a radius R1 substantially equal to the thickness S of the vane 20, the thickness S being measured at the point of the central body 22*c* of vane 20.

In the example shown in FIG. 1, the vane 20 is free to slide in a direction passing through the rotation axis (O) of said rotor 18, the external circumference CE of the rotor 18 is tangential to the side wall 16 of the chamber 14 along a tangential line (in FIG. 1, this is illustrated by the point T), parallel to the rotation axis (O) of the rotor 18, and the transversal section of the side wall 16 comprises a part shaped as an arc of circumference with a predetermined radius R2.

In particular, an operational configuration of the vacuum pump 10 is illustrated wherein the vane 20 is positioned with the longitudinal axis X at right angles with respect to the plane defined by the rotation axis (O) of the rotor 18 and by said tangential line (T).

In this position, the longitudinal axis X intersects the side wall 16 at the points A and B: the distance between the points A and B defines a theoretical length LT of the vane 20.

Points A and B are the end points of the aforesaid arc of circumference of radius R2, and this arc of circumference passes through the tangential line (T). Furthermore, the centre point O1 of the arc of circumference of radius R2 is set on the plane defined by the rotation axis (O) of the rotor 18 and said tangential line (T).

The remaining part of the transversal section of the side wall 16 is the geometrical locus of the points generated by point B when rotor 18 is rotated in a clockwise direction, thus moving point A along the aforesaid arc of circumference of radius R2, the distance between the points A and B being kept constant.

Thus, the transversal section of the side wall 16 has a substantially elliptical shape. The end portions 22*a* and 22*b* intersect the longitudinal axis X of the vane 20 at the points A1 and B1, the distance between points A1 and B1 being the actual length L of the vane 20, said length L being less than the theoretical length LT of the vane 20, as illustrated in FIG. 1. In particular, in the prior art, quite a considerable difference exists between the theoretical length LT and the length L, approximately 0.5-07 mm, for example.

Figure 3:
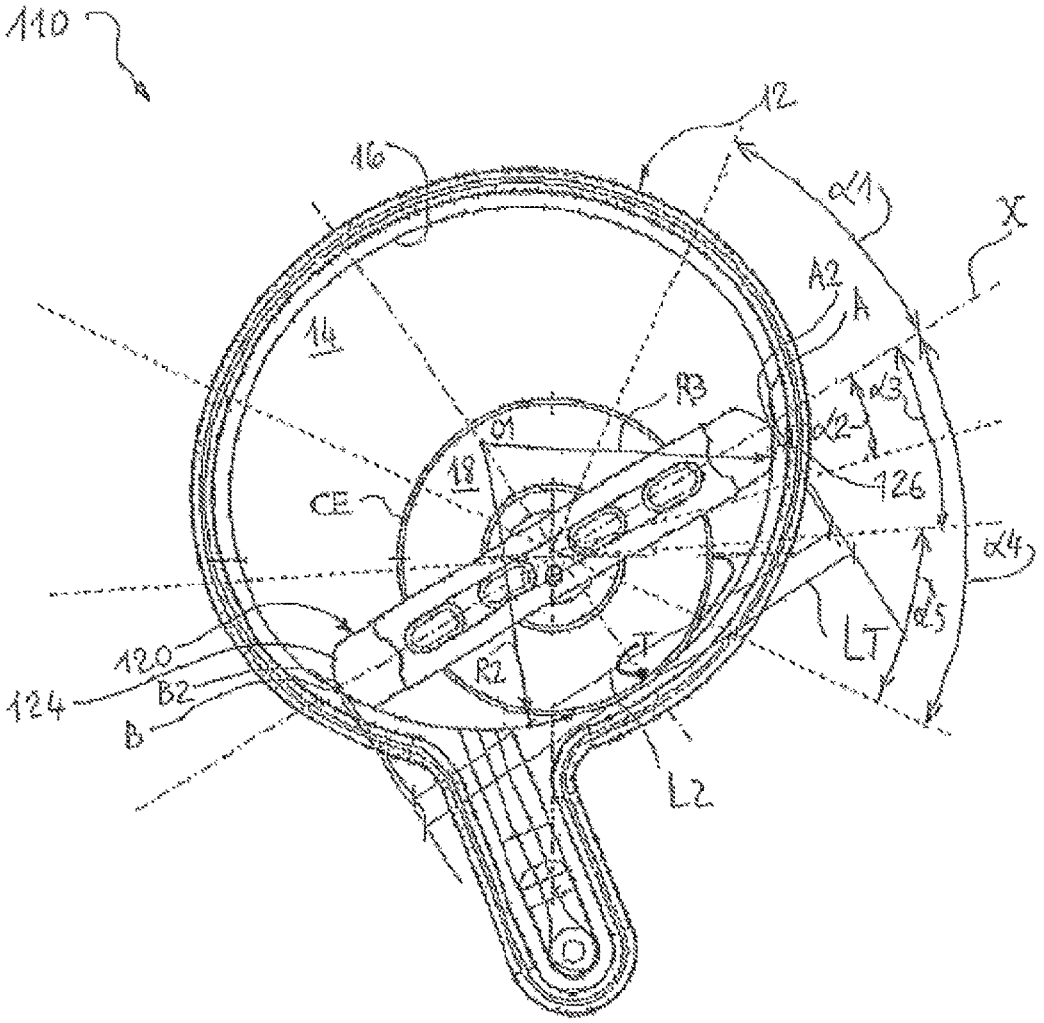
FIG. 3 is a schematic plane view seen from above of a single-vane vacuum pump according to the present invention, without the upper cover to show the chamber of the stator.

FIG. 3 shows a single-vane vacuum pump according to the present invention, that is identified by the reference numeral 110.

All structural elements identical or equivalent from a functional point of view to those of the vacuum pump 10 of the prior art described above with reference to FIG. 1 will be assigned the same reference numerals and will not be described any further.

Figure 4:
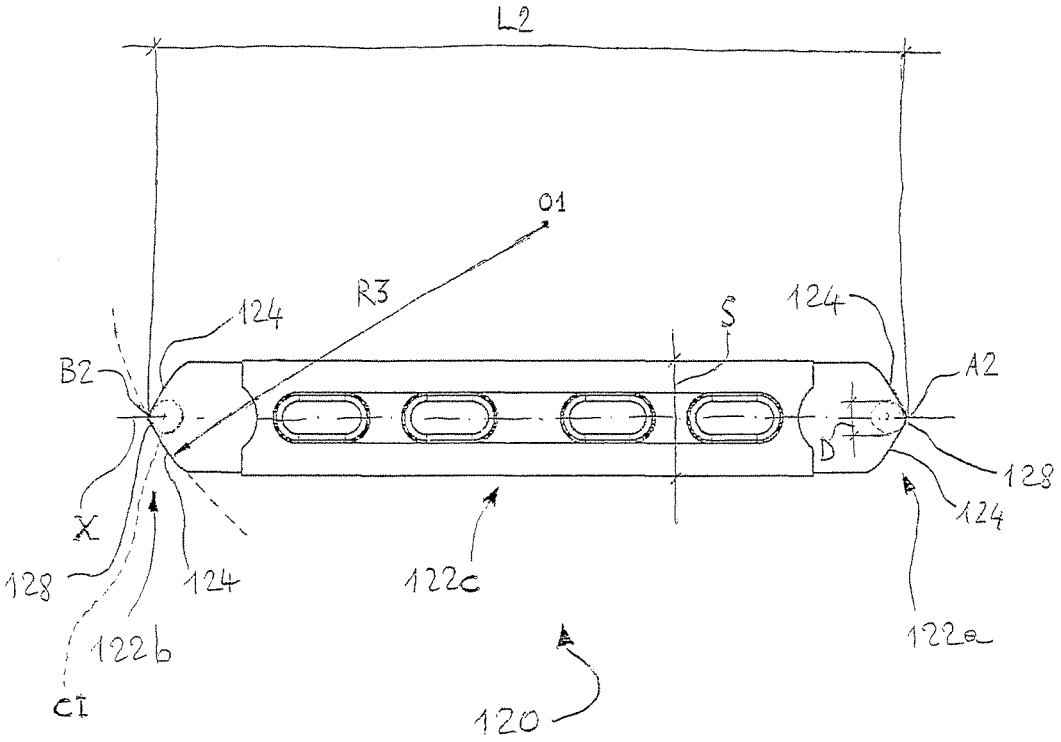
FIG. 4 is a schematic plane view seen from above, and in enlarged scale, of the vane included in the vacuum pump shown in FIG. 3.

In particular, the vacuum pump 110 differs from the vacuum pump 10 in that a different vane is provided, identified by reference numeral 120, that replaces the vane 20 of the prior art. FIG. 4 shows said vane 120 in more detail.

The vane 120 is mounted on the rotor 18 and is free to slide in a direction at right angles with respect to the rotation axis (O) of the rotor 18, said vane 120 having a predetermined length L2, a predetermined thickness S (measured at the central body 122*c* of the vane 120 and in the example illustrated, equal to the thickness S of the vane 20) and two opposite end portions 122*a* and 122*b* that in operation substantially slide wall 16 of the chamber 14. Like vane 20, vane 120 is comprised of a central body 122*c* and two end portions 122*a* and 122*b* that are integrally formed with each other. As for vane 120 being integrally formed, which is seen in FIGS. 3 and 4, the vane 120 is one piece that is smoothly continuous in form and that all (i.e., 122*a*, 122*b*, and 122*c*) making up the whole of the vane are inseparable.

In accordance with the present invention, the longitudinal section of at least one of said end portions 122*a* and 122*b* (in FIGS. 3 and 4, both said end portions) of the vane 120 comprise at least one part 124 having a bend radius R3 substantially equal to a part 126 of the transversal section of the side wall 16 of the chamber 14 when the vane 120 is in one reference operating position, such as that shown in FIG. 3.

The following description will explain more clearly that said reference operating position is defined at the configuration of maximum stress of the end portions 122*a* and 122*b* of the vane 120 against the side wall 16 of the chamber 14, or in other words the configuration where the force of inertia and the centrifugal force of vane 120 have the greatest effect.

In the preferred embodiment of the invention, shown in FIG. 3, the vane 120 is free to slide in a direction passing through rotation axis (O) of the rotor 18, the external circumference CE of the rotor 18 is tangential to side wall 16 of the chamber 14 along one tangential line (in FIG. 3, this is shown by point T), parallel to the rotation axis (O) of the rotor 18, and the transversal section of the side wall 16 comprises a part shaped as an arc of circumference with a predetermined radius R2.

In accordance with the present invention, the longitudinal section of each of the end portions 122*a* and 122*b* of the vane 120 comprises two opposite parts 124, symmetrical with respect to the longitudinal axis X of the vane 120 and having respective bend radii R3 substantially equal to the aforesaid predetermined radius R2.

In particular, parts 124 of the vane 120 are shaped so that—during the rotor 18 rotation—they are each time substantially in contact with the side wall 16 of the chamber 14 when the longitudinal axis X of the vane 120 is at right angles with respect to the plane defined by the rotation axis (O) of the rotor 18 and by said tangential line (T): in this manner, the end portions 122*a* and 122*b* of the vane 120 slide along the side wall 16 of the chamber 14 with large contact surface areas in the operational zones wherein the vane 120 is subjected to most stress.

In the example shown in FIG. 3, the operational zones wherein the vane 120 is most subjected to stress are precisely those around the position wherein the longitudinal axis X of the vane 120 is at right angles with respect to the plane defined by the rotation axis (O) of the rotor 18 and by the aforesaid tangential line (T).

In particular, in the example shown in FIG. 3, the effects of the force of inertia and of the centrifugal force of the vane 120 are at a maximum at an angle α1 equal to about 30°, the angle α1 being that wherein, during clockwise rotation of the rotor 18, the vane 120 precedes by about 30° the position wherein the longitudinal axis X of the vane 120 is at right angles with respect to the plane defined by the rotation axis (O) of the rotor 18 and by said tangential line (T). The operational zones wherein the vane 120 is most subjected to stress are approximately those between the aforesaid angle α1 and the angle α2 equal to about 15°, the angle α2 being that wherein, during clockwise rotation of the rotor 18 the vane 120 follows by about 15° the position wherein the longitudinal axis X of the vane 120 is at right angles with respect to the plane defined by the rotation axis (O) of the rotor 18 and by said tangential line (T).

As shown in FIG. 3, the two parts 124 of each of the end portions 122*a* and 122*b* have a substantially pointed shape, due to the fact that they are oriented to converge towards the end of the vane.

Preferably, said opposite parts 124 of the longitudinal section of each of said end portions 122*a* and 122*b* of said vane 120 are radiused, at the longitudinal axis X of the vane 120, by a circumferential arc 128.

In particular, the diameter D of the ideal circumference CI (shown by the dotted line in FIG. 4) that defines said arc of circumference 128 between said opposite parts 124, is smaller than the thickness S of the vane 120. Preferably, the ratio between the diameter D of the ideal circumference CI that defines said arc of circumference 128 and the thickness S of the vane ranges between ⅕ and ¼.

Advantageously, with the aforesaid values, the Applicant observed that it is possible to obtain vanes 120 having a length L2 that varies very little from the theoretical length LT described previously with reference to FIG. 1 (it should be noted that the theoretical length LT of the vane 20 in FIG. 1 is equal to the theoretical length LT of the vane 120 in FIG. 3 and the transversal section of the side wall 16 in FIG. 1 is equal to the transversal section of the side wall 16 in FIG. 3).

In particular, the end portions 122*a* and 122*b* intersect the longitudinal axis X of the vane 120 at the points A2 and B2, the distance between the points A2 and B2 being the length L2 of the vane 120, said length L2 being less than the theoretical length LT of the vane 20, as shown in FIG. 3. Thanks to this invention, as can be observed when comparing FIGS. 1 and 3, drawn on the same scale, the difference between the theoretical length LT and length L2 is noticeably less than the difference between the theoretical length LT and the length L in FIG. 1, for example of 0.1 mm.

The aforesaid reduced difference between the theoretical length LT and the length L2 provides the great advantage of drastically limiting the aforesaid damage (undulations formed by the removal of material) on the wall 16 of the chamber 14, provoked by the play between the vane 120 and wall 16 of the chamber 14, especially in those operational positions of the vane 120 wherein the force of inertia of the vane 120 substantially counterbalances the centrifugal force of the vane 120. In particular, in the example shown in FIG. 3, the aforesaid operational positions are roughly defined in an angular sector with angle α5 defined between an angle α3 and an angle α4, said angles α3 and α4 being respectively those wherein, during clockwise rotor 18 rotation, vane 120 follows by about 25° and about 55° the position wherein the longitudinal axis X of the vane 120 is at right angles with respect to the plane defined by the rotation axis (O) of the rotor 18 and by said tangential line (T).

Figure 5:
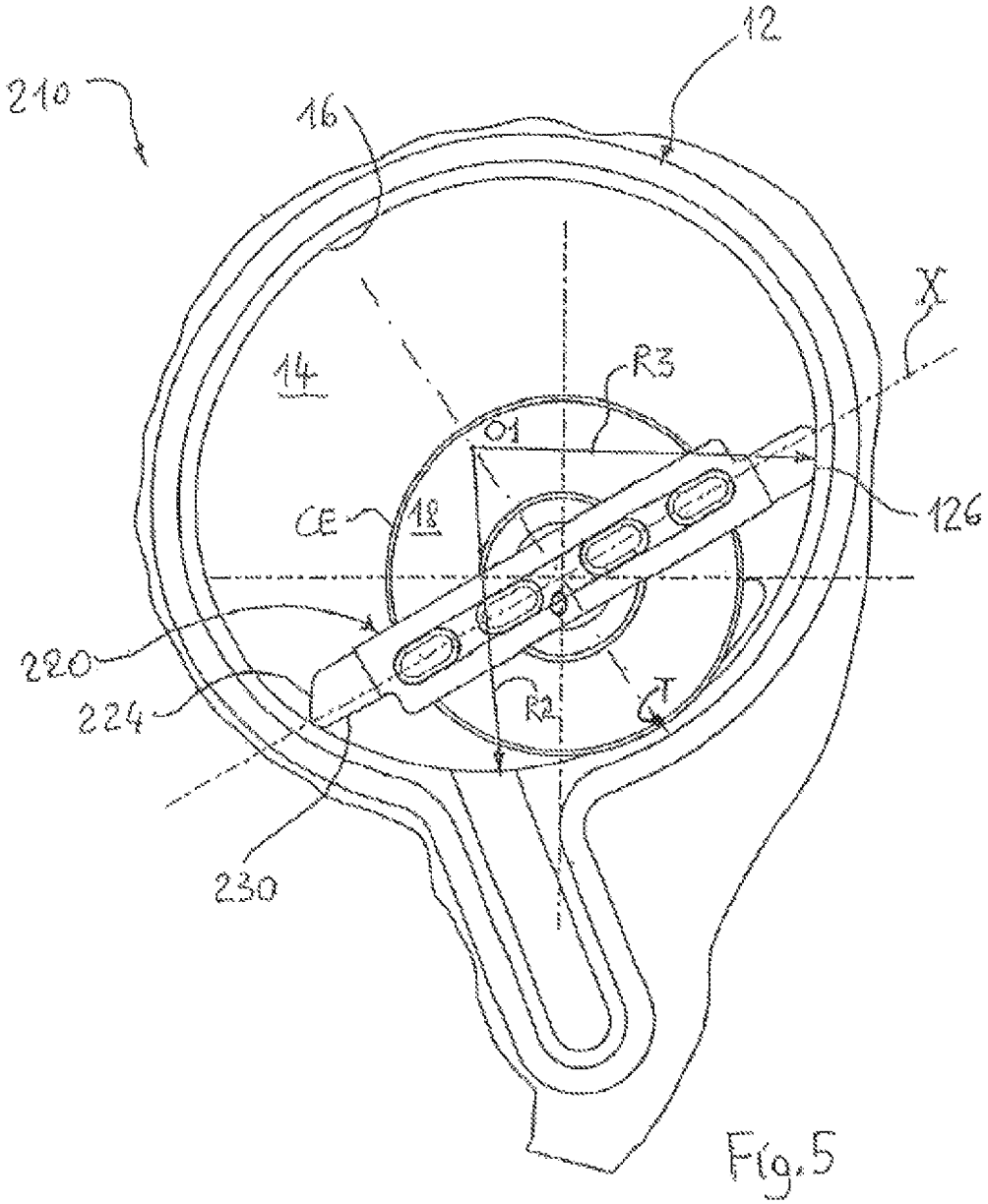
FIG. 5 is a schematic plane view seen from above of a further embodiment of a single-vane vacuum pump according to the present invention, without the upper cover to show the chamber of the stator.

FIG. 5 shows a further embodiment of a single-vane vacuum pump according to the present invention, identified by the reference numeral 210.

In FIG. 5, all structural elements identical or equivalent from a functional point of view to those of the vacuum pump 110 in FIG. 3 will be assigned the same reference numerals and will not be described any further.

Figure 6:
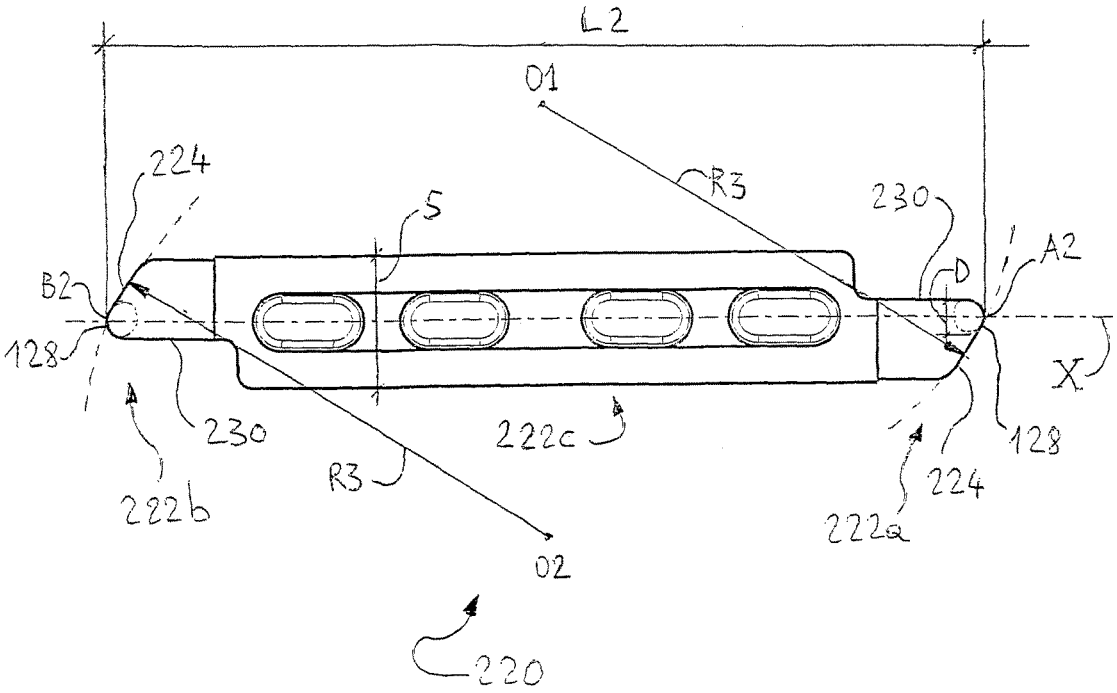
FIG. 6 is a schematic plane view seen from above, and in enlarged scale, of the vane included in the vacuum pump shown in FIG. 5.

In particular, the vacuum pump 210 differs from the vacuum pump 110 because a different vane is provided, identified by reference numeral 220, that replaces the vane 120 of FIG. 4. FIG. 6 shows said vane 220 in greater detail.

The vane 220 is mounted on rotor 18 and is free to slide in a direction at right angles with respect to the rotation axis (O) of the rotor 18, said vane 220 having a predetermined length L2, a predetermined thickness S (measured at the central body 222*c* of the vane 120 and, in the illustrated example, equal to the thickness S of the vane 120) and two opposite end portions 222*a* and 222*b* that, during operation of the vacuum pump 210, substantially slide along side wall 16 of the chamber 14.

In accordance with this embodiment of the present invention, the longitudinal section of at least one of said end portions 222*a* and 222*b* (in FIGS. 5 and 6, both said end portions) of the vane 220 comprises a part 224 having a bend radius R3 substantially equal to the predetermined radius R2 of the part 126 of the transversal section of the side wall 16 of the chamber 14.

Preferably, the two parts 224 of said end portions 222*a* and 222*b* are positioned on opposite sides with respect to the longitudinal axis X of said vane 220, that is the two curvature centres O1 and O2 of said parts 224 are symmetrical with respect to the longitudinal axis X of said vane 220.

Each of the end portions 222*a* and 222*b* has, on the opposite side with respect to the longitudinal axis X of the respective part 224, a part 230 that is substantially parallel to the longitudinal axis X of said vane 220.

The part 224 and the part 230 of each end portion 222*a* and 222*b* are radiused at the longitudinal axis X of the vane 220, by an arc of circumference 228, preferably of a size similar to the arc of circumference 128 of FIGS. 3 and 4.

Obviously, those skilled in the art are able to apply numerous changes and variants to the single-vane vacuum pump for a motor vehicle engine and to the vane for a single-vane vacuum pump as described above, in order to satisfy specific and related requirements, while remaining within the scope of the present invention which will be defined in the following claims.

For example, the shape of the transversal section of the chamber 14 could be different from that illustrated in the attached drawings and described above. In particular, the part of the side wall 16 between points A, T and B could be different from an arc of circumference; in this case, the radius R3 described above will be the bend radius that defines this part of side wall 16.

The invention claimed is:

1. A vacuum pump for a motor vehicle engine, comprising:

a stator;

a vacuum chamber defined inside said stator, said vacuum chamber having a side wall whose transversal section has a predetermined substantially elliptical shape;

a rotor mounted in said vacuum chamber and capable of rotating around a rotation axis parallel to said side wall;

a single vane mounted on said rotor and free to slide in a direction at right angles with respect to the rotation axis of said rotor, said single vane comprising a central body having a predetermined length and two opposite end portions that are integrally formed with said central body;

wherein relative movements between the central body and the two opposite end portions are prevented, and wherein the single vane is one piece, is smoothly continuous in form and all portions making up the whole of the vane are inseparable;

said end portions substantially sliding along the side wall of said vacuum chamber;

each of said end portions of said single vane comprising two opposite surfaces, said two opposite surfaces symmetrical with respect to a longitudinal axis of said single vane, each surface of said two opposite surfaces is shaped to have a bend radius substantially equal to that of a part of said side wall, when said single vane is in at least one reference operating position, wherein said part is shaped as a circumferential arc having a predetermined radius and is located on the same side of said surface with respect to said longitudinal axis;

wherein said single vane is free to slide in a direction passing through the rotation axis of said rotor, the external circumference of said rotor is tangential to the side wall of the chamber along a tangential line parallel to the rotation axis of the rotor, wherein one of said two opposite surfaces of each end portion has a respective curvature centre that is different from the curvature centre of the other of said two opposite surfaces.

2. The vacuum pump according to claim 1, wherein said at least one reference operating position is defined at a configuration of maximum stress of the end portions of said single vane against the side wall of the chamber.

3. The vacuum pump according to claim 1, wherein said two opposite surfaces of each of said end portions of said single vane are radiused, at a longitudinal axis of said single vane, by an arc of circumference.

4. The vacuum pump according to claim 3, wherein the diameter of the ideal circumference that defines said arc of circumference is smaller than the thickness of said single vane.

5. The vacuum pump according to claim 4, wherein the ratio between the diameter of the ideal circumference that defines said arc of circumference and the thickness of said single vane ranges between about ⅕ and about ¼.

6. A vacuum pump for a motor vehicle engine, comprising:

a stator;

a vacuum chamber defined inside said stator, said vacuum chamber having a side wall whose transversal section has a predetermined substantially elliptical shape;

a rotor mounted in said vacuum chamber and capable of rotating around a rotation axis parallel to said side wall;

a single vane mounted on said rotor and free to slide in a direction at right angles with respect to the rotation axis of said rotor, said single vane comprising a central body having a predetermined length and two opposite end portions that are integrally formed with said central body;

wherein relative movements between the central body and the two opposite end portions are prevented, and wherein the single vane is one piece, is smoothly continuous in form and all portions making up the whole of the vane are inseparable;

said end portions substantially sliding along the side wall of said vacuum chamber;

each of said end portions of said single vane comprises two opposite surfaces symmetrical with respect to a longitudinal axis of said single vane and shaped to have a bend radius substantially equal to that of a part of said side wall, when said single vane is in at least one reference operating position, wherein said part is shaped as a circumferential arc having a predetermined radius;

wherein said single vane is free to slide in a direction passing through the rotation axis of said rotor, the external circumference of said rotor is tangential to the side wall of the chamber along a tangential line parallel to the rotation axis of the rotor, wherein one of said two opposite surfaces has a respective curvature centre that is different from the curvature centre of the other of said two opposite surfaces;

wherein said two opposite surfaces of each of said end portions of said single vane are radiused, at a longitudinal axis of said single vane, by an arc of circumference, wherein the diameter of the ideal circumference that defines said arc of circumference is smaller than the thickness of said single vane, wherein the ratio between the diameter of the ideal circumference that defines said arc of circumference and the thickness of said single vane ranges between ⅕ and ¼.

7. A vacuum pump for a motor vehicle engine, comprising:

a stator;

a vacuum chamber defined inside said stator, said vacuum chamber having a side wall whose transversal section has a predetermined substantially elliptical shape;

a rotor mounted in said vacuum chamber and capable of rotating around a rotation axis parallel to said side wall;

a single vane mounted on said rotor and free to slide in a direction at right angles with respect to the rotation axis of said rotor, said single vane comprising a central body having a predetermined length and two opposite end portions that are integrally formed with said central body;

wherein relative movements between the central body and the two opposite end portions are prevented, and wherein the single vane is one piece, is smoothly continuous in form and all portions making up the whole of the vane are inseparable;

said end portions substantially sliding along the side wall of said vacuum chamber;

each of said end portions of said single vane comprises two opposite surfaces symmetrical with respect to a longitudinal axis of said single vane and shaped to have a bend radius substantially equal to that of a part of said side wall, when said single vane is in at least one reference operating position, wherein said part is shaped as a circumferential arc having a predetermined radius;

wherein said single vane is free to slide in a direction passing through the rotation axis of said rotor, the external circumference of said rotor is tangential to the side wall of the chamber along a tangential line parallel to the rotation axis of the rotor, wherein one of said two opposite surfaces has a respective curvature centre that is different from the curvature centre of the other of said two opposite surfaces;

wherein said at least one reference operating position is defined at a configuration of maximum stress of the end portions of said single vane against the side wall of the chamber, said configuration of maximum stress being defined at zones of the chamber which are around the position wherein the longitudinal axis of the vane is at right angles with respect to the plane formed by the rotor rotation axis and a tangential line of the external circumference of the rotor with the side wall of the chamber, said tangential line being parallel to the rotor rotation axis.

* * * * *